US006776113B2

(12) United States Patent
Sakakibara et al.

(10) Patent No.: US 6,776,113 B2
(45) Date of Patent: Aug. 17, 2004

(54) SEWING MACHINE WITH THREAD TENSION CONTROL FUNCTION AND THREAD TENSION CONTROL PROGRAM THEREFOR

(75) Inventors: Kaoru Sakakibara, Nagoya (JP); Akira Kaiya, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/600,580

(22) Filed: Jun. 23, 2003

(65) Prior Publication Data

US 2004/0000262 A1 Jan. 1, 2004

(30) Foreign Application Priority Data

Jun. 28, 2002 (JP) ..... 2002-189149

(51) Int. Cl.[7] ..... D05B 19/12; D05B 47/00; D05B 73/00

(52) U.S. Cl. ..... 112/470.01; 112/254; 112/302

(58) Field of Search ..... 112/470.01, 302, 112/254, 255, 270; 242/170, 171, 410

(56) References Cited

U.S. PATENT DOCUMENTS 4,183,313 A * 1/1980 Odermann et al. ..... 112/302
6,641,598 B2 * 11/2003 Shimizu et al. ..... 112/302

FOREIGN PATENT DOCUMENTS

JP B2 2650261 5/1997
JP A 2000-3982639 12/2000
WO WO 02/053821 A1 7/2002

* cited by examiner

*Primary Examiner*—Peter Nerbun
(74) *Attorney, Agent, or Firm*—Oliff & Berridge, PLC

(57) ABSTRACT

A sewing machine includes a thread cassette having a thread accommodating cavity in which a supply of thread is accommodated, a cassette mount to which the thread cassette is detachably attached, a thread tensioner adjusting a tension of the thread drawn from the thread cassette, a detachment operating member operated so that the thread cassette is detached from the cassette mount, and a thread tension control controlling the thread tensioner so that the thread is set at a predetermined tension when the detachment operating member has been operated.

10 Claims, 17 Drawing Sheets

SEWING MACHINE WITH THREAD TENSION CONTROL FUNCTION AND THREAD TENSION CONTROL PROGRAM THEREFOR

BACKGROUND OF THE INVENTION

1. Field of the Invention

This invention relates to a sewing machine including a cassette mount to which a thread cassette is attached and a thread tension control program therefor, and more particularly to a technique for reliably and desirably adjusting the tension of a thread drawn from the thread cassette when the thread cassette is attached to and detached from the cassette mount.

2. Description of the Related Art

Sewing machines have commercially been provided including a cassette mount to which a thread cassette enclosing a thread spool or bobbin is detachably attached in order that a thread drawn from the thread spool may be used as an upper thread. The thread drawn from the thread cassette attached to the cassette mount is placed between a pair of thread tension discs. The thread extending from the thread tension discs is further placed on a thread take-up. The thread extending from the thread take-up is passed through an eye of a sewing needle so that the thread is set.

In one type of the above-described sewing machines, the thread drawn from the thread cassette is automatically placed between the thread tension discs. However, in order that sewing may be started, the thread tension discs need to be closed so that the thread is held therebetween. Furthermore, in order that the thread cassette may be detached from the cassette mount, the thread tension discs need to be opened so that the thread is released from the held state.

In view of the aforesaid requirement, the assignee of the present application filed a patent application for a sewing machine including a thread tension disc operating mechanism operated mechanically in synchronization with attachment of the thread cassette. This Japanese patent application was published on Jul. 10, 2002 under the publication number JP-A-2002-191884. In the disclosed sewing machine, a pair of thread tension discs are held in a closed state when a thread cassette is absent in a cassette mount. When the thread cassette is inserted into the cassette mount, the thread tension disc operating mechanism is firstly operated to open the thread tension discs.

The thread drawn from the thread cassette is subsequently placed between the thread tension discs, and simultaneously, the discs are closed such that the thread is held between the discs. Furthermore, when the thread cassette is detached from the cassette mount, the above-described operation is performed in a reverse sequence by the thread tension disc operating mechanism so that the thread is released from the thread tension discs.

U.S. Pat. No. 3,749,039 to Russell A. Fritts discloses a sewing machine including a rotatable guide member provided at the thread tension disc side. The guide member corresponds to a part of the aforesaid thread tension disc operating mechanism and is rotated by attaching and detaching the thread cassette to and from the cassette mount, whereby the thread tension discs are opened and closed. Furthermore, the prior art has provided a technique for opening a pair of thread tension discs by raising a presser foot pressing cloth. Additionally, a lever may be provided which is operated to detach the thread cassette from the thread attaching portion.

In the aforesaid sewing machine disclosed in JP-A-2002-191884, however, the thread tension disc operating mechanism and the thread tension discs are operated in response to attachment or detachment of the thread cassette to or from the cassette mount. The force operating the thread tension disc operating mechanism and the thread tension discs needs to be exerted by an operator. Since this increases load of the operator, the thread cassette cannot be attached to and detached from the cassette mount smoothly. Furthermore, the thread tension discs closed need to be opened and thereafter re-closed when the thread cassette is attached to the cassette mount. However, it is difficult to obtain proper timings for the opening and closure of the thread tension discs. Accordingly, the thread extending from the thread cassette cannot sometimes be caught by the thread tension discs reliably. The thread cassette needs to be re-attached to the cassette mount when the thread has not been caught by the thread tension discs. This would result in troublesomeness.

SUMMARY OF THE INVENTION

Therefore, an object of the present invention is to provide a sewing machine in which the load imposed on the operator can be reduced with improved smoothness in the attachment and detachment of the thread cassette when the thread cassette is attached to and detached from the cassette mount, and the tension of the thread drawn from the thread cassette can be adjusted reliably and desirably, and to provide a thread tension control program which can be applied to the sewing machine.

The present invention provides a sewing machine comprising a thread cassette having a thread accommodating cavity in which a supply of thread is accommodated, a cassette mount to which the thread cassette is detachably attached, a thread tensioner adjusting a tension of the thread drawn from the thread cassette, a detachment operating member operated so that the thread cassette is detached from the cassette mount, and a thread tension control controlling the thread tensioner so that the thread is set at a predetermined tension when the detachment operating member has been operated.

The tension of thread drawn from the thread cassette is adjusted by the thread tensioner in the above-described sewing machine. The detachment operating member is operated so that the thread cassette is allowed to be detached from the cassette mount. Upon operation of the detachment operating member, the thread tension control controls the thread tensioner so that the predetermined tension is applied to the thread. Accordingly, the load imposed on the operator can be reduced with improvement of the smoothness in the attachment and detachment of the thread cassette when the operator detaches the thread cassette from the cassette mount. Consequently, the tension of the thread drawn from the thread cassette can be adjusted reliably and desirably.

In a preferred form, the thread tension control opens the thread tensioner when the detachment operating member has been operated. In another preferred form, the thread tensioner applies no tension to the thread when the thread tensioner is opened. Furthermore, the sewing machine preferably further comprises a thread tensioner opening mechanism operated in synchronization with the detachment operating member and opening the thread tensioner when the detachment operating member is operated.

The invention also provides a sewing machine comprising a thread cassette having a thread accommodating cavity in which a supply of thread is stored, a cassette mount to which the thread cassette is detachably attached, a thread tensioner adjusting a tension of the thread drawn from the thread cassette, a cassette detector detecting the thread cassette having been attached to the cassette mount, and a thread tension control controlling the thread tensioner so that the thread is tensioned a predetermined period of time after detection of the thread cassette by the cassette detector.

The tension of thread drawn from the thread cassette is adjusted by the thread tensioner also in the above-described sewing machine. When having been attached to the cassette mount, the thread cassette is detected by the cassette detector. The thread tensioner is controlled by the thread tension control the predetermined period of time after detection of the thread cassette by the cassette detector, whereupon the thread drawn from the thread cassette is tensioned. Thus, the thread drawn from the thread cassette is tensioned the predetermined period of time after detection of the thread cassette by the cassette detector. Consequently, the thread can reliably be caught and held by the thread tensioner.

The aforesaid predetermined period of time is preferably set at a value not more than 30 msec.

BRIEF DESCRIPTION OF THE DRAWINGS

Other objects, features and advantages of the present invention will become clear upon reviewing the following description of an embodiment of the invention, made with reference to the accompanying drawings, in which:

FIG. 16 is a first half of a flowchart showing a thread tension control and the like; and FIG. 17 is a second half of the flowchart showing the thread tension control and the like.

DETAILED DESCRIPTION OF THE INVENTION

Figure 1:
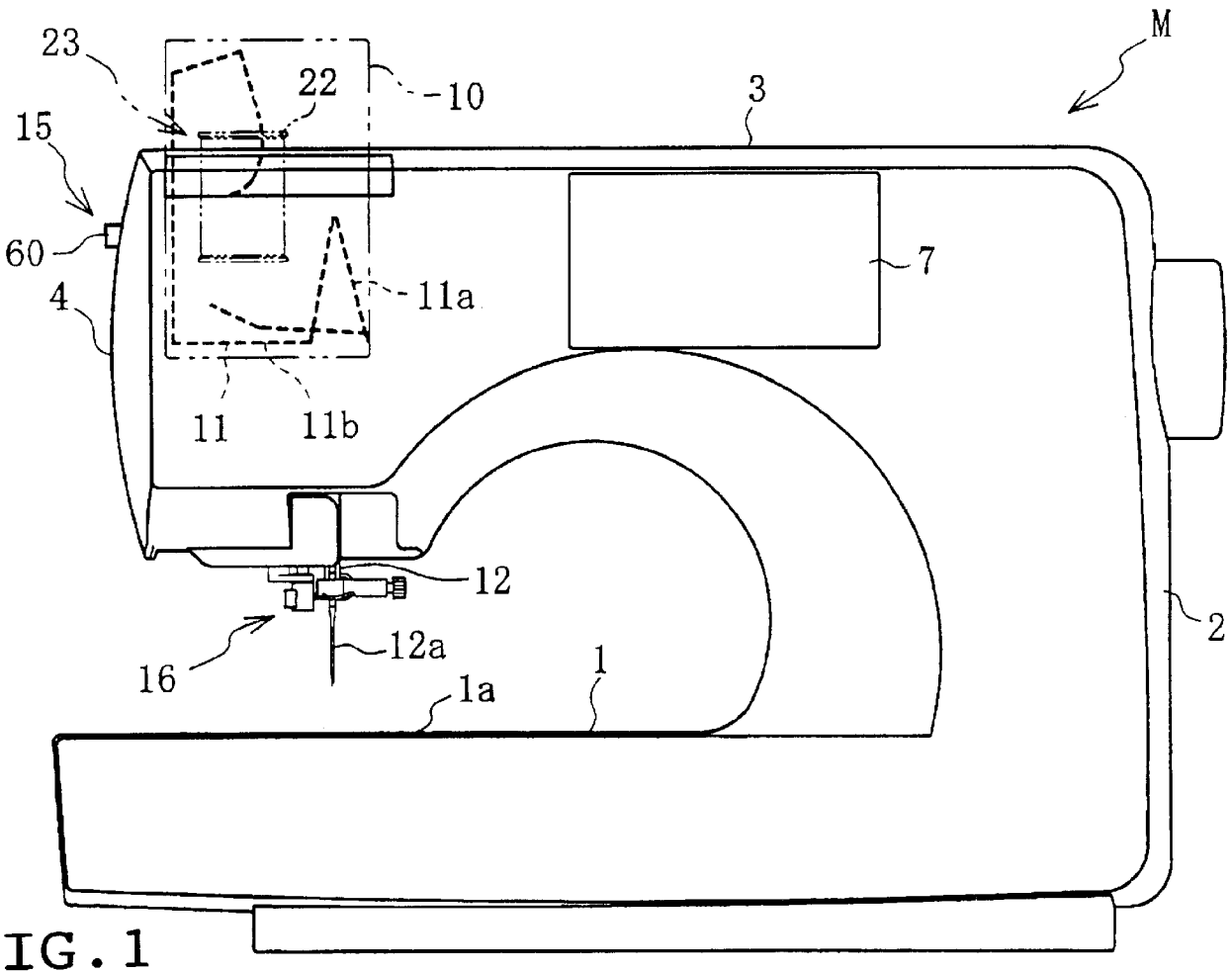
FIG. 1 is a front view of a sewing machine in accordance with one embodiment of the present invention with a thread cassette being attached thereto.

One embodiment of the present invention will be described with reference to the accompanying drawings. In the embodiment, the present invention is applied to a household sewing machine provided with a cassette mount to which a thread cassette having a thread accommodating cavity in which a supply of thread is accommodated is detachably attached.

Referring to FIGS. 1 to 4, the household sewing machine M includes a sewing bed 1 having a horizontal plane, a pillar 2 standing from a right end of the bed 1, a sewing arm 3 extending leftward from an upper end of the pillar 2 so as to be opposed along the bed 1, and a machine head 4 located at a left end of the arm 3. The head 4 is provided with a cassette mount 5 to which a thread cassette 10 is detachably attached. A thread 11 drawn from the thread cassette 10 attached to the cassette mount 5 serves as a needle thread. The arm 3 or the head 4 thereof includes operation switches 6 (see FIG. 14) such as a sewing start switch, a sewing finish switch, etc. The arm 3 further includes a liquid crystal display 7. A touch panel 8 (see FIG. 14) is provided on the surface of the display 7.

In the head 4 are provided a needle bar 12, a needle thread take-up 13, a thread tensioning mechanism 14 for adjusting a tension of the thread 11 drawn from the thread cassette 10, and a thread tension releasing mechanism 15 rendering the thread tensioning mechanism 14 open when a detachment operating member has been operated, as shown in FIGS. 2, 4, 9 and 10. The head 4 also includes a threading mechanism 16 for automatically passing a thread 11 through an eye of a sewing needle 12*a* attached to the needle bar 12 when the thread cassette 10 is attached to the cassette mount 5, a thread guiding mechanism 17 for automatically catching the thread 11 on a thread guard of the needle bar 12 and the like when the thread cassette 10 is attached to the cassette mount 5, a needle bar driving mechanism 18 for moving the needle bar 12 up and down, a needle bar swinging mechanism 19 for swinging the needle bar 12, a needle thread take-up driving mechanism, etc.

Figure 5:
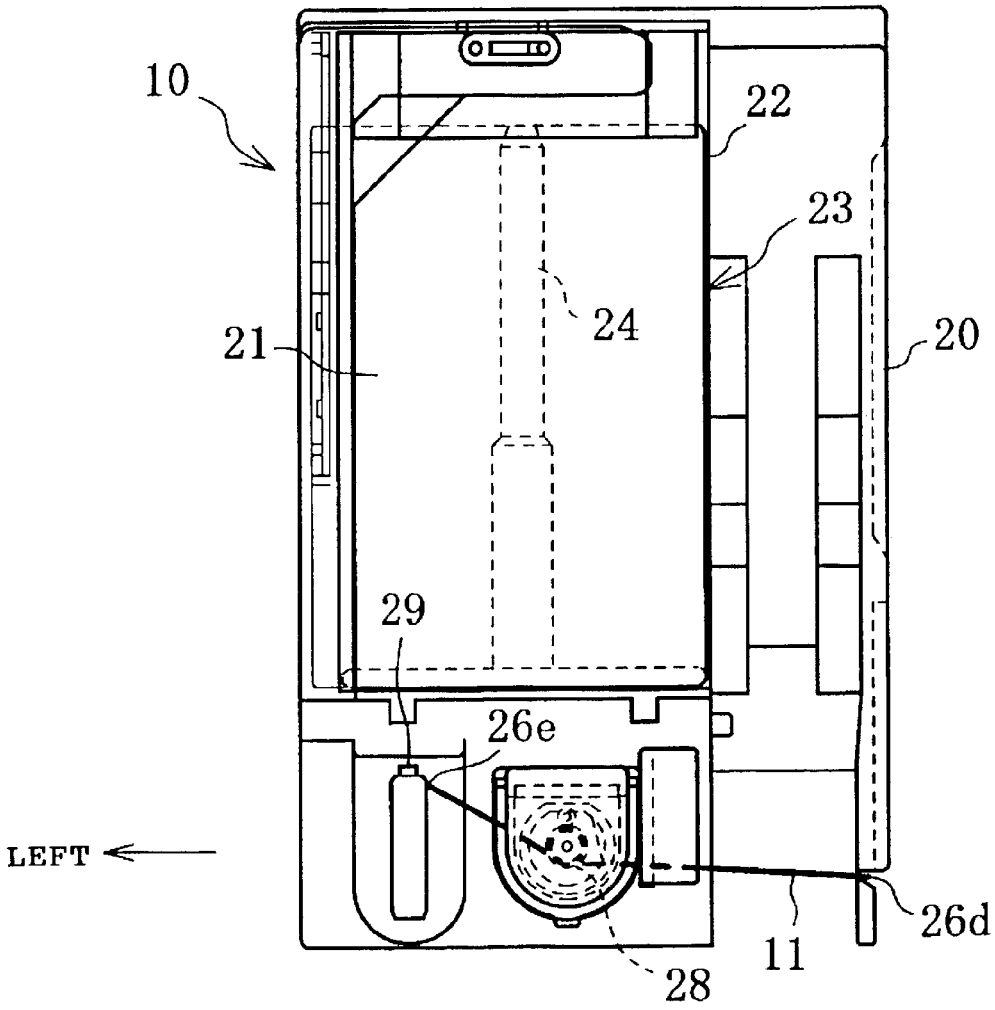
FIG. 5 is a front view of the thread cassette.
Figure 6:
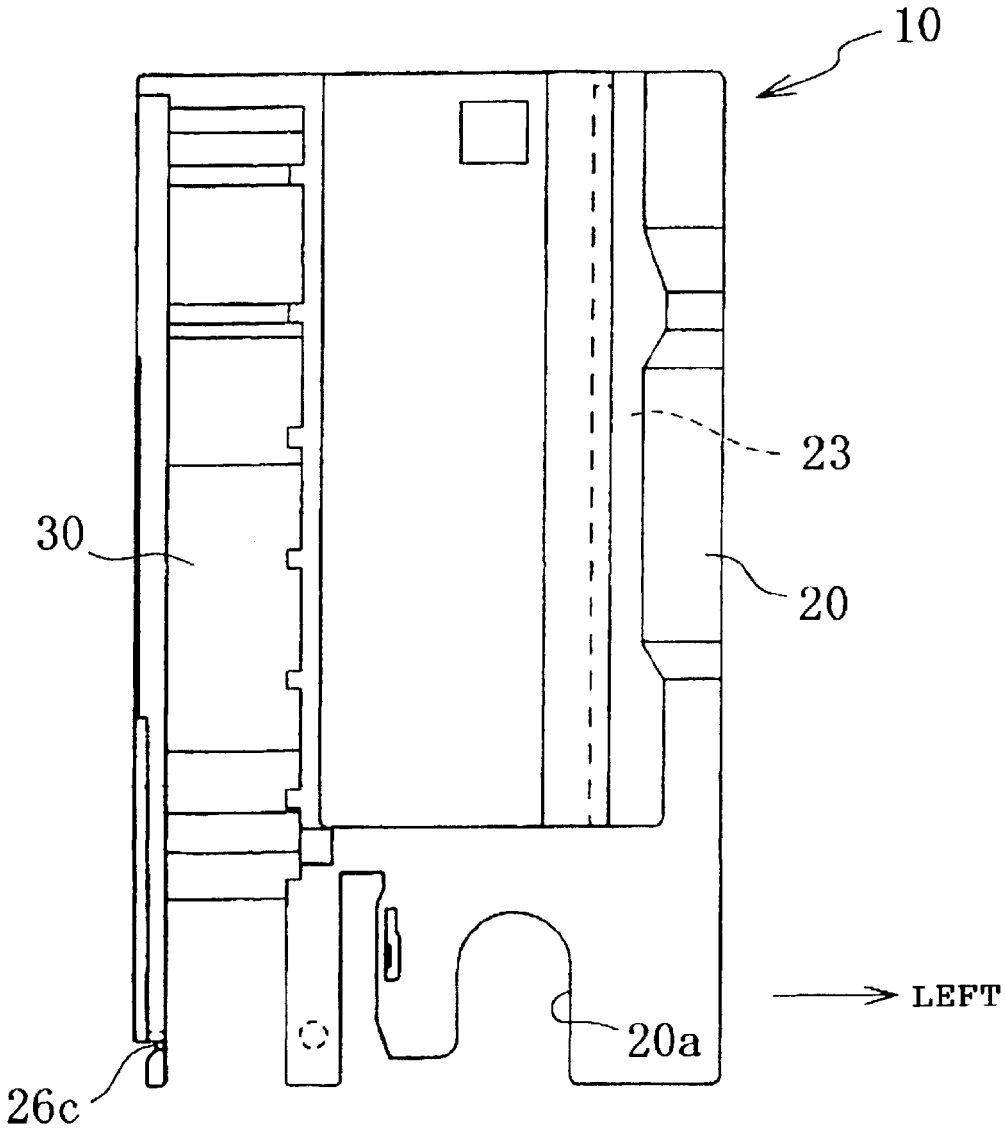
FIG. 6 is a rear view of the thread cassette.

The thread 11 drawn from the thread cassette 10 attached to the cassette mount 5 is put on a thread tensioning shaft 40 (see FIG. 11 etc.) between thread tension discs 41 and 42 of the thread tensioning mechanism 14 from above, as shown in FIGS. 5 and 6. The thread 11 further extending from the thread tensioning shaft 40 downstream is put on the needle thread take-up 13. The thread 11 further extending from the needle thread take-up 13 downstream is passed through an eye of the needle 12*a* attached to the needle bar 12, whereupon the thread 11 is set for the sewing.

The bed 1 is provided with a bobbin mount (not shown). A thread extending from a bobbin (not shown) attached to the bobbin mount serves as a bobbin thread. A shuttle mechanism (not shown) is provided in the bed 1. When a sewing machine motor 9 (see FIG. 14) is driven with the needle and bobbin threads being set, the needle bar 12 is moved up and down by the needle bar driving mechanism 18 and the shuttle mechanism is driven in synchronization with the movement of the needle bar 12, so that the needle thread 11 located near the needle 12*a* descended below a throat plate 1*a* is caught by the shuttle mechanism, whereupon the needle and bobbin threads are entangled to be formed into stitches.

Figure 7:
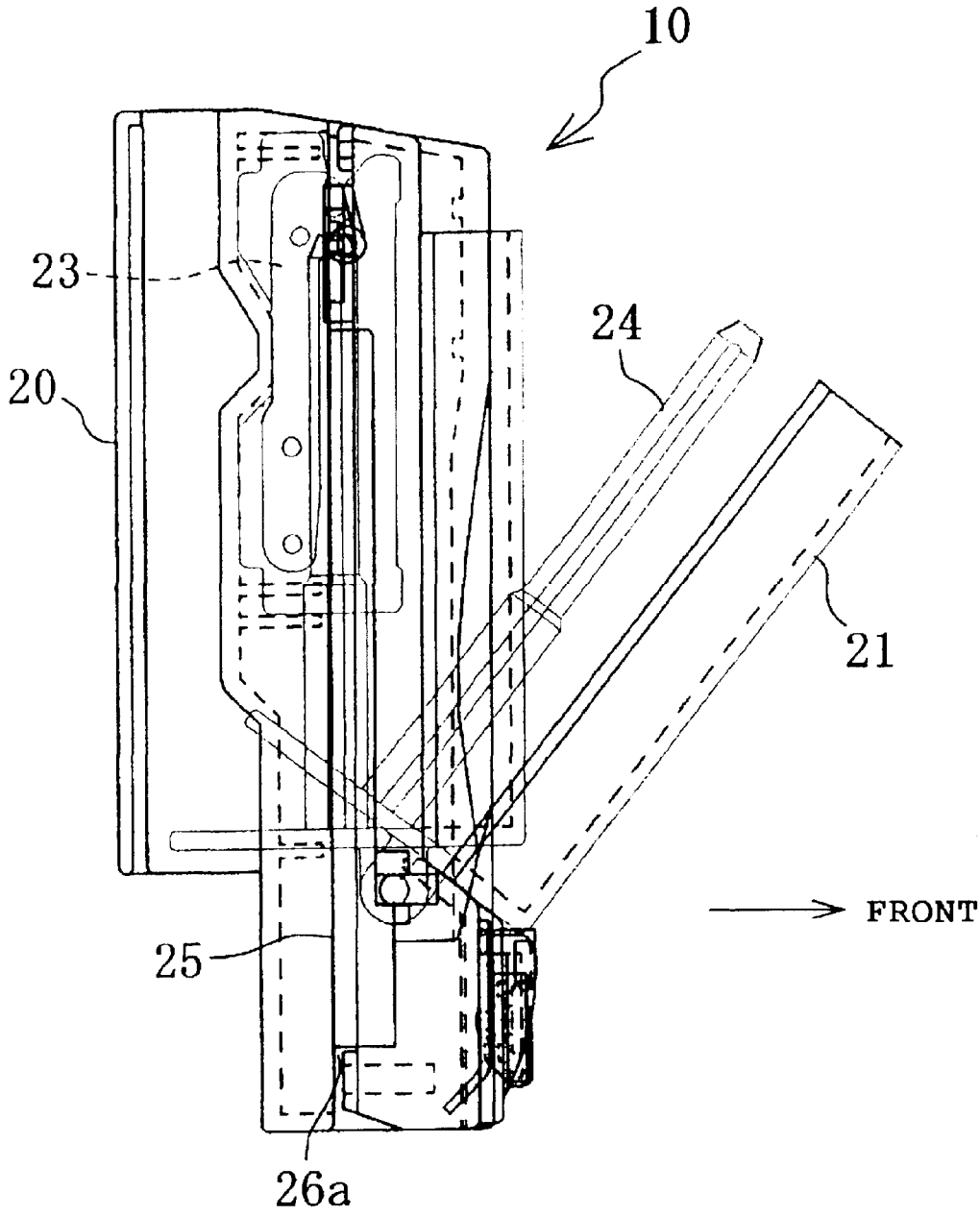
FIG. 7 is a left side view of the thread cassette with a lid open.
Figure 8:
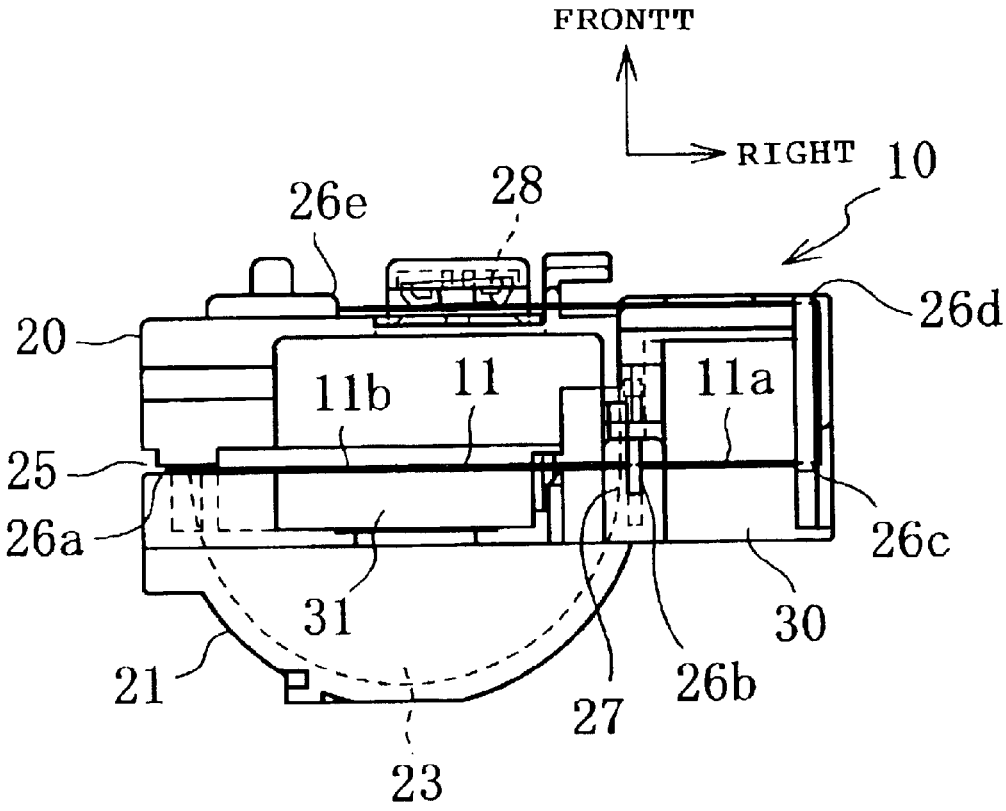
FIG. 8 is a bottom view of the thread cassette.

The thread cassette 10 will now be described in detail. The thread cassette 10 includes a cassette body 20 and a lid 21 pivotally mounted on the cassette body as shown in FIGS. 5 to 8. The cassette body 20 with the lid 21 defines therein a thread accommodating cavity 23 for accommodating a thread spool 22 serving as a supply of thread. A spool pin 24 is mounted on the lid 21. When the lid 21 is opened forward as shown in FIG. 7, the thread spool 22 is allowed to be attached to and detached from the spool pin 24. When the lid 21 is closed with the thread spool 22 attached to the spool pin 24, the thread spool is enclosed in the thread accommodating cavity 23.

The thread 11 extends upward from the thread spool 22 to be drawn out of the thread accommodating cavity 23. The thread 11 further extends through a thread path 25 defined between the cassette body 20 and a left-hand end of the lid 21. The thread 11 is then put on a first thread guard 26*a* at a left lower end of the thread cassette 10, further extending rightward thereafter to be put on a second thread guard 26*b* at a lower end of a partition wall 27 and a third thread guard 26*c* at a right lower end of the thread cassette 10. The thread 11 further extends forward to be put on a fourth thread guard 26*d* and is then returned to extend leftward. The thread 11 is then retained on a thread retainer 28. Furthermore, the thread 11 extending leftward is cut by a left blade 29 of the thread retainer 28 and the resultant thread end is put on a fifth thread guard 26*e* near the blade 29.

The thread 11 is thus set in the thread cassette 10 as described above prior to attachment to the cassette mount 5. A needle thread take-up guide space 30 defined at a right end of the thread cassette 10 extends substantially over the length of the cassette. The guide space 30 is open at the rear and the lower portion of the cassette. A thread tension space 31 is defined at a central lower end of the thread cassette 10 and open at a lower portion thereof. These spaces 30 and 31 are partitioned by a partition wall 27.

The thread cassette 10 is descended to be inserted into the cassette mount 5. In this case, the needle thread take-up 13 and a needle thread take-up guide 13*a* (see FIG. 2) guiding the former enter the guide space 30 from below the cassette, and the thread tensioning shaft 40 and thread tension discs 41 and 42 of the thread tensioning mechanism 14 enter the thread tension space 31 from below the cassette. The cassette body 20 has a notch 20*a* formed in a lower end of the rear wall thereof in order that the thread tensioning shaft 40 and the like may be prevented from interfering with the thread cassette 10. When the thread cassette 10 has been inserted slightly into the cassette mount 5, a thread part 11*a* between the thread guards 26*b* and 26*c* is caught by the needle thread take-up 13 in the guide space 30.

Figure 2:
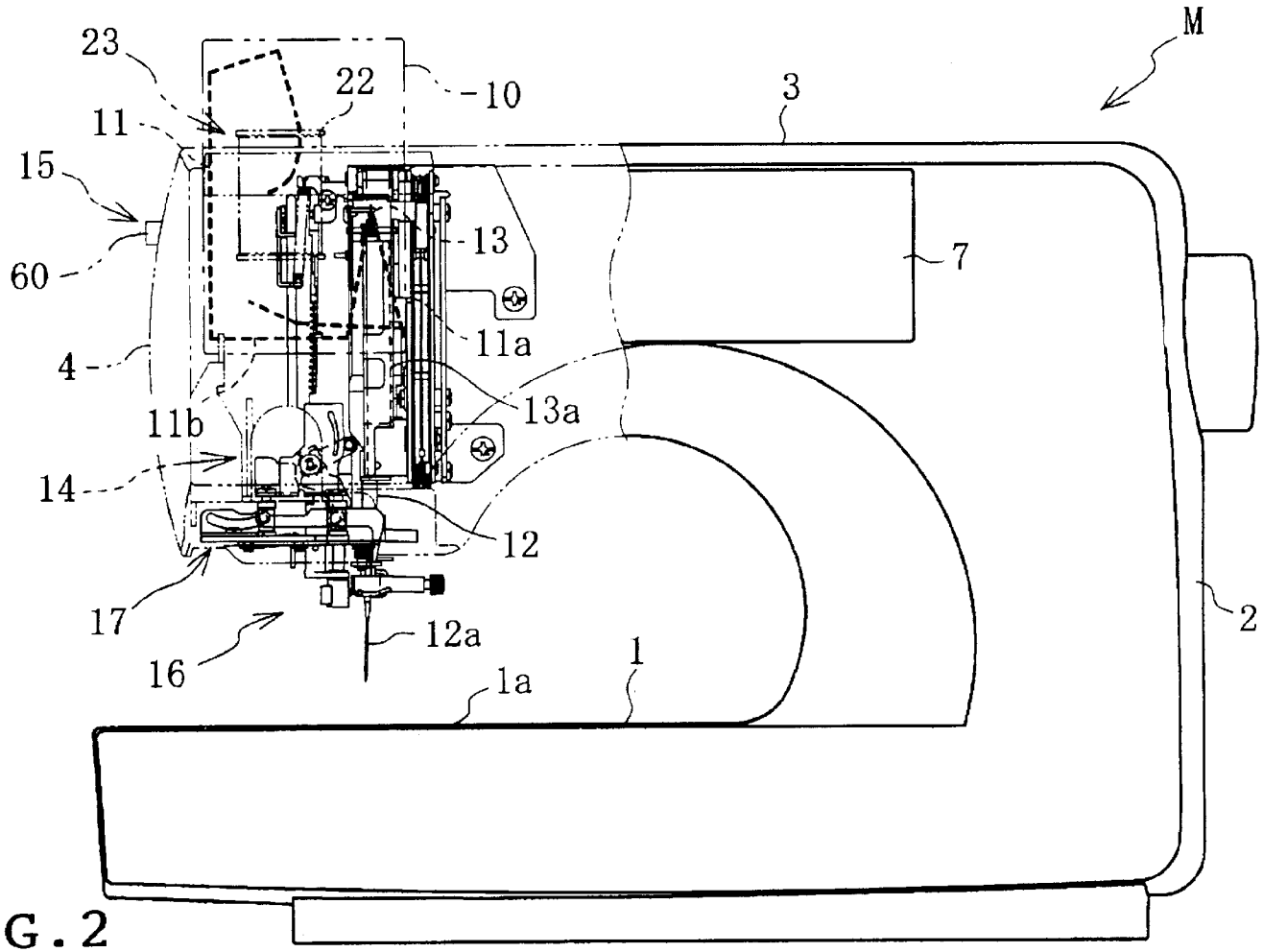
FIG. 2 is a front view of the sewing machine with a head thereof broken.
Figure 3:
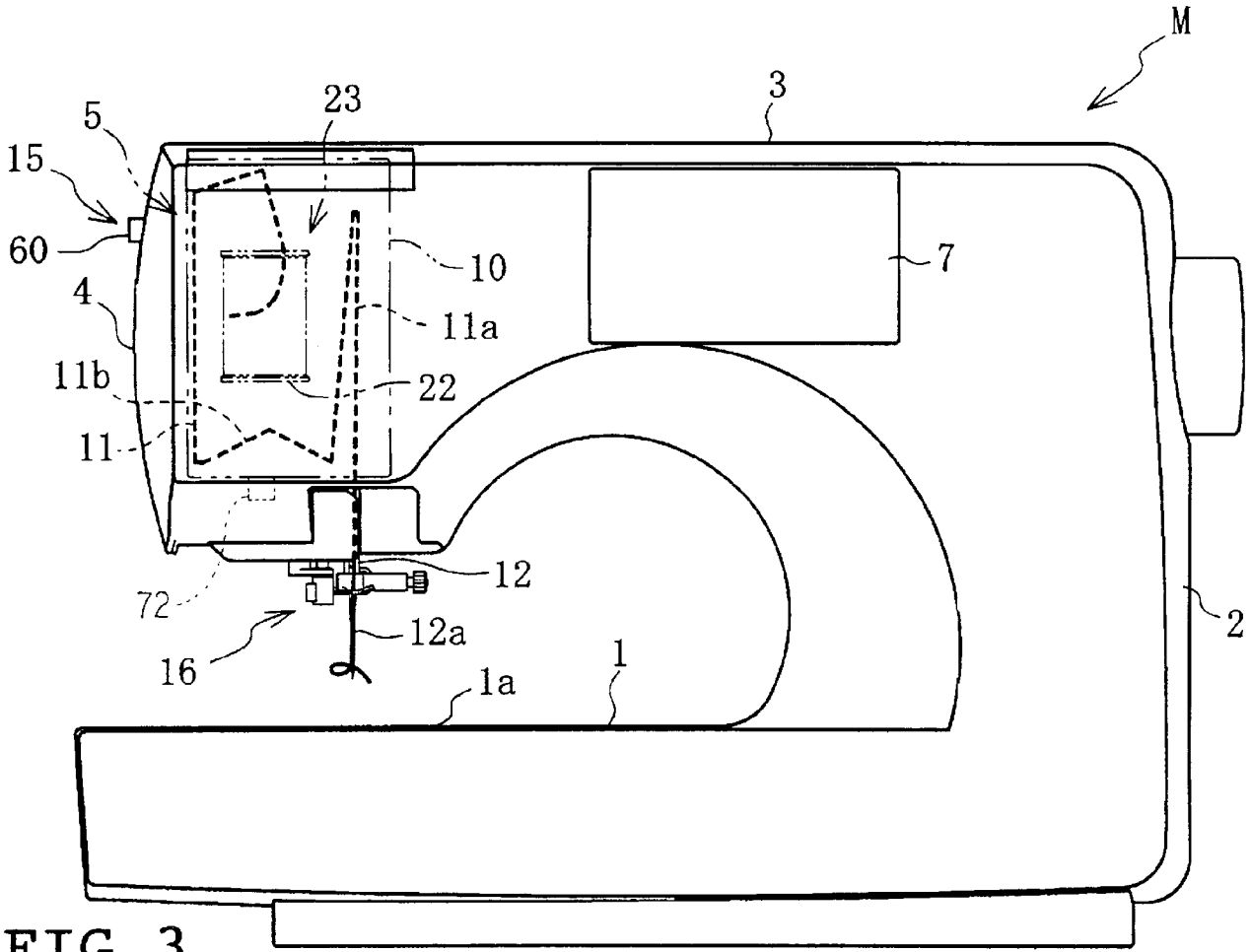
FIG. 3 is a front view of the sewing machine with the thread cassette having been attached to the cassette mount.
Figure 4:
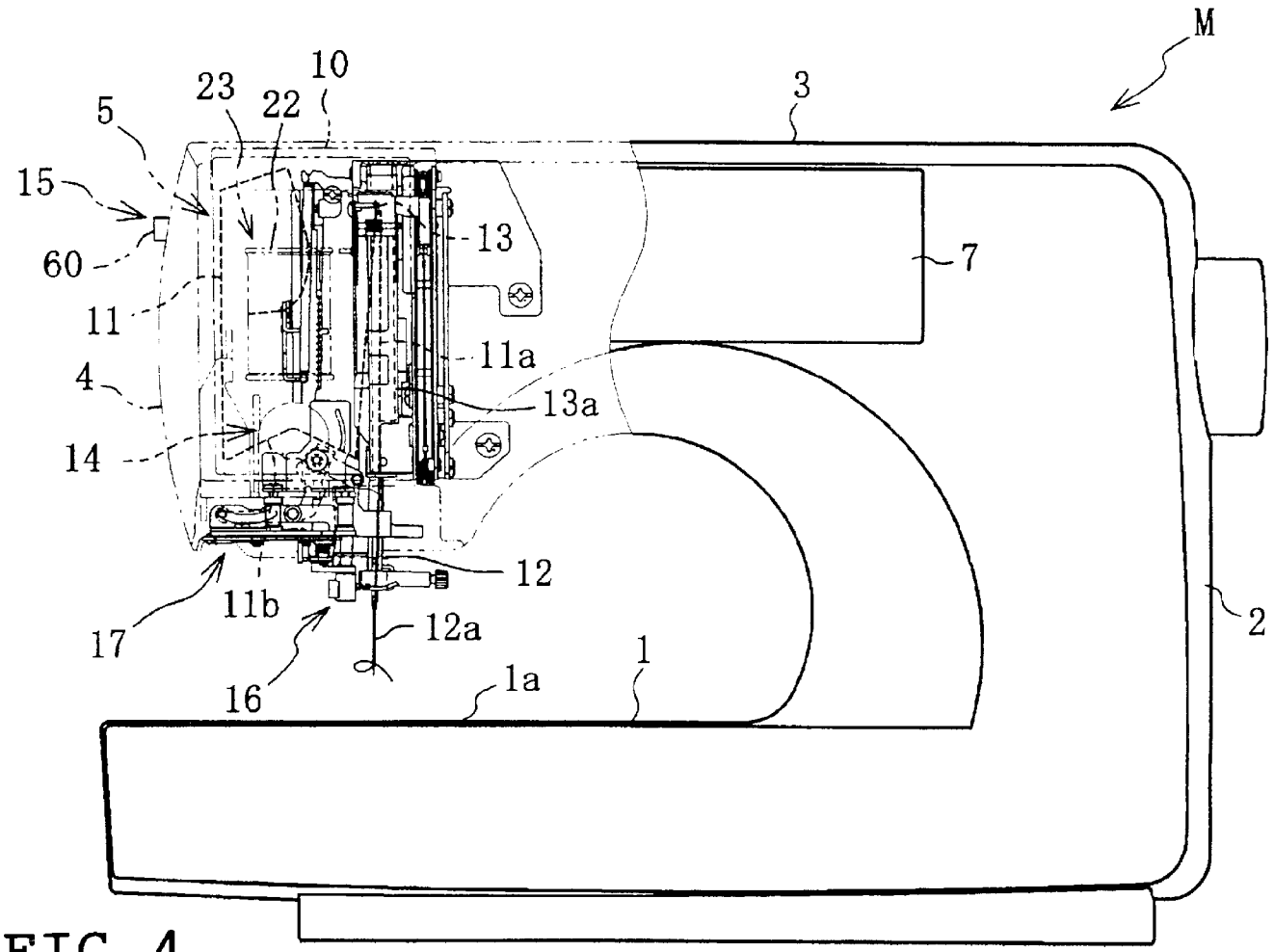
FIG. 4 is a front view of the sewing machine with the thread cassette having been attached to the cassette mount, in which view the head thereof is broken.

Subsequently, when the thread cassette 10 is further inserted into the cassette mount 5, the thread guards 26*a* and 26*b* are descended relative to the needle thread take-up 13 on which the thread part 11*a* has been caught. Since the thread 11 located downstream the caught thread part 11*a* is continuously held by the thread retainer 28, the thread 11 is drawn from the thread spool 22 in the thread accommodating cavity 23. For example, the thread part 11*a* takes a generally triangular configuration when about two thirds of the thread cassette 10 has been inserted into the cassette mount 5 as shown in FIGS. 1 and 2. When the thread cassette 10 has been attached to the cassette mount 5, the thread part 11*a* between the thread guards 26*a* and 26*b* is caught by a portion of the thread tensioning shaft 40 between the thread tension discs 41 and 42 in the thread tension space 31, as shown in FIGS. 3 and 4.

The thread tensioning mechanism 14 will now be described. The thread tensioning mechanism 14 comprises the thread tensioning shaft 40 fixed to a frame 40*a* and extending forward, the front thread tension disc 41 fixedly fitted with the shaft 40, and the rear thread tension disc 42 fitted with the shaft 40 so as to be brought into a face-to-face contact with the front disc 41, as shown in FIGS. 9 to 13B. The thread tensioning mechanism 14 further comprises a thread tension spring 42*a* provided about the shaft 40 to urge the rear disc 42 against the front disc 41 and a driving mechanism 43 opening and closing the paired thread tension discs 41 and 42. The driving mechanism 43 includes a pulse motor 44, a driving gear 45, a cam 46, links 47 and 48, a rotating link 49, an extension coil spring 50, a pushing link 51, and an opening lever 52. The pulse motor 44 includes an output shaft to which is secured the driving gear 45 in mesh engagement with a gear 46*a* of the cam 46. The link 47 is pivotally mounted on a support shaft 47*a* at a central portion thereof so as to be pivoted about a horizontal axis. The link 47 has a cam follower 47*b* provided on an upper end thereof and a pin 47*c* provided on a lower end thereof. The cam follower 47*b* is engaged with a cam groove 46*b* of the cam 46 and the pin 47*c* is engaged with a centrally located elongated hole 48*a* of the link 48. The link 48 is supported so as to be movable right and left.

Figure 11:
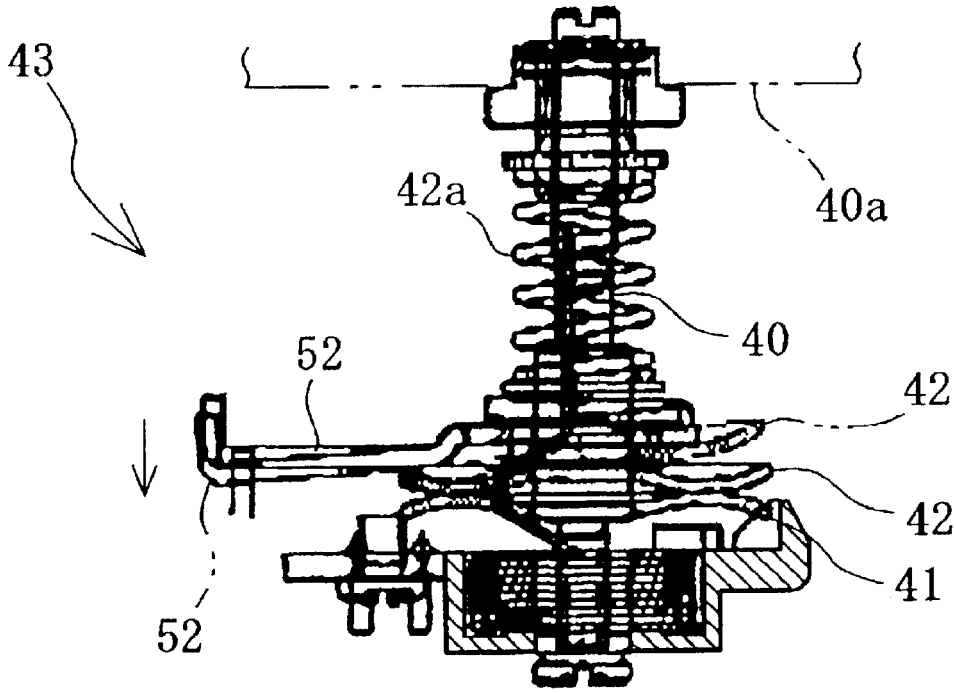
FIG. 11 is a plan view of thread tension discs and the like of a thread tensioning mechanism.

The rotating link 49 is pivotally mounted on a support shaft 49*a* at a central portion thereof so as to be pivoted about a vertical axis. The rotating link 49 is further urged by the extension coil spring 50 in the counter-clockwise direction. The rotating link 49 has an engaging portion 49*b* formed on a rear end thereof. The engaging portion 49*b* engages the left end elongated hole 48*a* of the link 48. A pin 49*c* provided on the right end of the rotating link 49 is engaged with a central elongated hole 51*b* of the pushing link 51. The pushing link 51 is pivotally mounted on a support shaft 51*a* at a central portion thereof so as to be pivoted about a vertical axis. The opening lever 52 is fixed to the rear thread tension disc 42 as shown in FIG. 11.

The paired thread tension discs 41 and 42 are closed when the cam follower 47*b* is in engagement with a cam groove 46*b*1 having the same diameter as the cam groove 46*b* as shown in FIG. 12. The cam groove 46*b*1 covers about 80 degrees. The pulse motor 44 can be driven in a range corresponding to the angle covered by the cam groove 46*b*1 while the cam follower 47*b* is maintained in engagement with the cam groove 46*b*1. The reason for this is that each of the pulse motor 44 and driving gear 45 is used as a part of the needle bar swinging mechanism 19. Consequently, the needle bar 12 can be swung while the thread tension discs 41 and 42 are closed. The needle bar swinging mechanism 19 includes the pulse motor 44, the driving gear 45, a gear 19*a* brought into mesh engagement with the driving gear 45, and a cam 19*b* fixedly mounted on the gear 19*a*. The needle bar swinging mechanism 19 swings the needle bar 12 by rotation of the cam 19*b*.

Figure 13A:
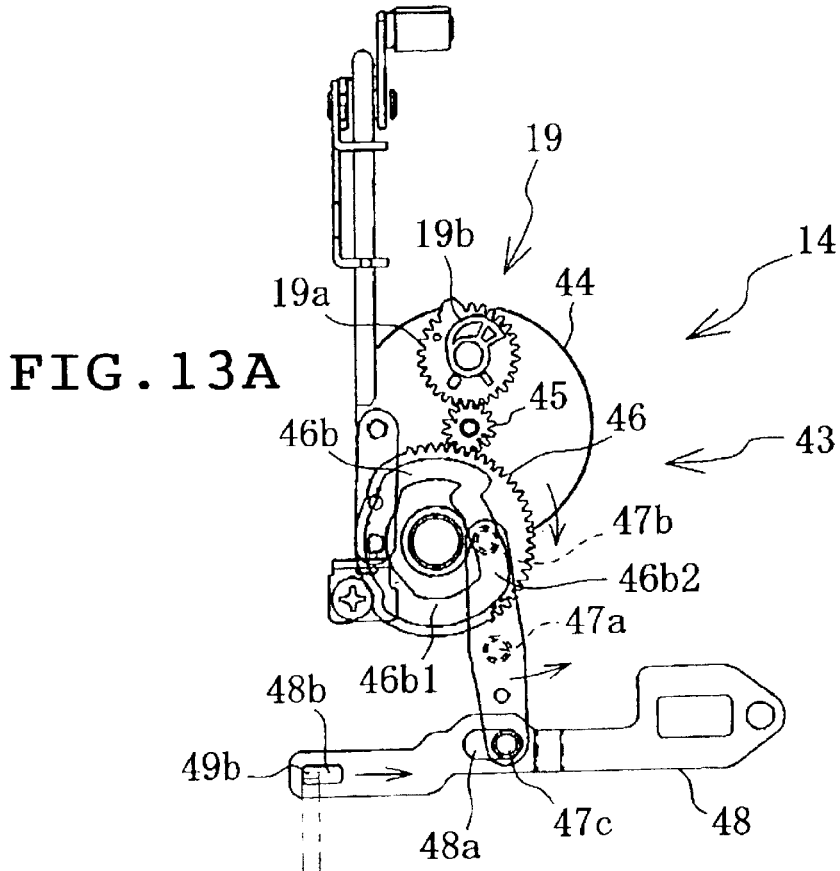
FIGS. 13A and 13B are a plan view and a side view of the thread tensioning mechanism in an open state respectively.
Figure 13B:
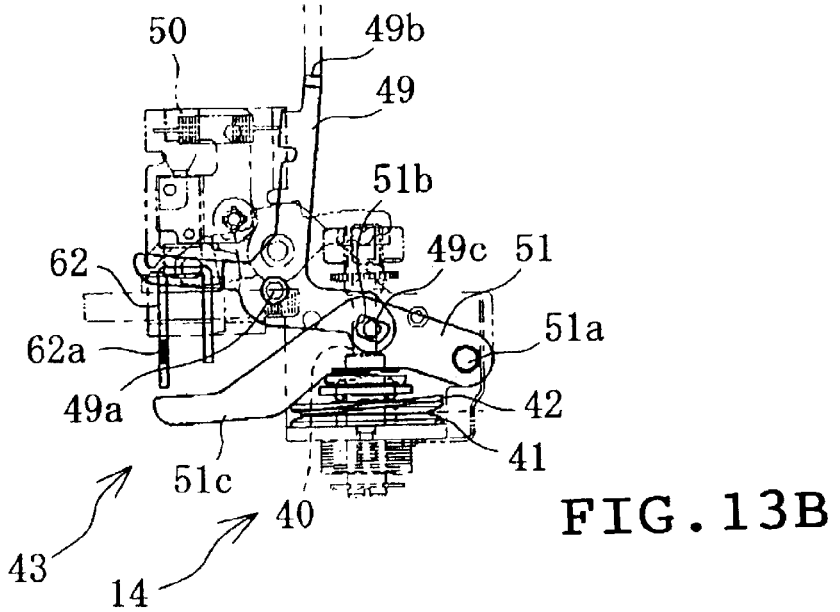

The cam 46 is rotated in the clockwise direction as shown by arrow in FIG. 13A upon drive of the pulse motor 44, so that the cam follower 47*b* engages the cam groove 46*b*2 of the cam 46*b*, moving to the central side of the cam 46. The links 47 and 48 and the rotating link 49 are then moved in the direction as shown by arrow in synchronization with the cam 46. The opening lever 52 is pushed forward by the left lever 51*c* of the pushing member 51 moved forward, whereupon the rear thread tension disc 42 is moved so as to be inclined. Consequently, the paired thread tension discs 41 and 42 are opened with a gap therebetween.

When the thread cassette 10 is attached to the cassette mount 5 with the thread tension discs 41 and 42 being opened, the thread part 11*b* of the thread 11 drawn from the thread cassette 10 is caught by the thread tensioning shaft 40 between the thread tension discs 41 and 42. The pulse motor 44 is then driven so that the cam 46 is rotated in the counterclockwise direction or in the direction opposed to the arrow in FIG. 13B. Since the urging force of the extension coil spring 50 returns the rotating link 49 to the former position, the thread tension discs 41 and 42 are closed by the thread tension spring 42*a*. When the thread tension discs 41 and 42 are open, the needle bar 12 is located at a position as shown by chain line in FIG. 9.

In order that the thread tension discs 41 and 42 may be controlled via the driving mechanism 43 of the thread tensioning mechanism 14 so as to be opened and closed, a cassette detecting switch 72 serving as a cassette detector is provided for detecting the thread cassette 10 having been attached to the cassette mount 5. The cassette detecting switch 72 is disposed on the bottom of the cassette mount 5. The cassette detecting switch 72 comprises, for example, a limit switch which is turned on when the thread cassette 10 has been attached to the cassette mount 5 and turned off when the thread cassette 10 has been detached from the cassette mount 5.

Figure 9:
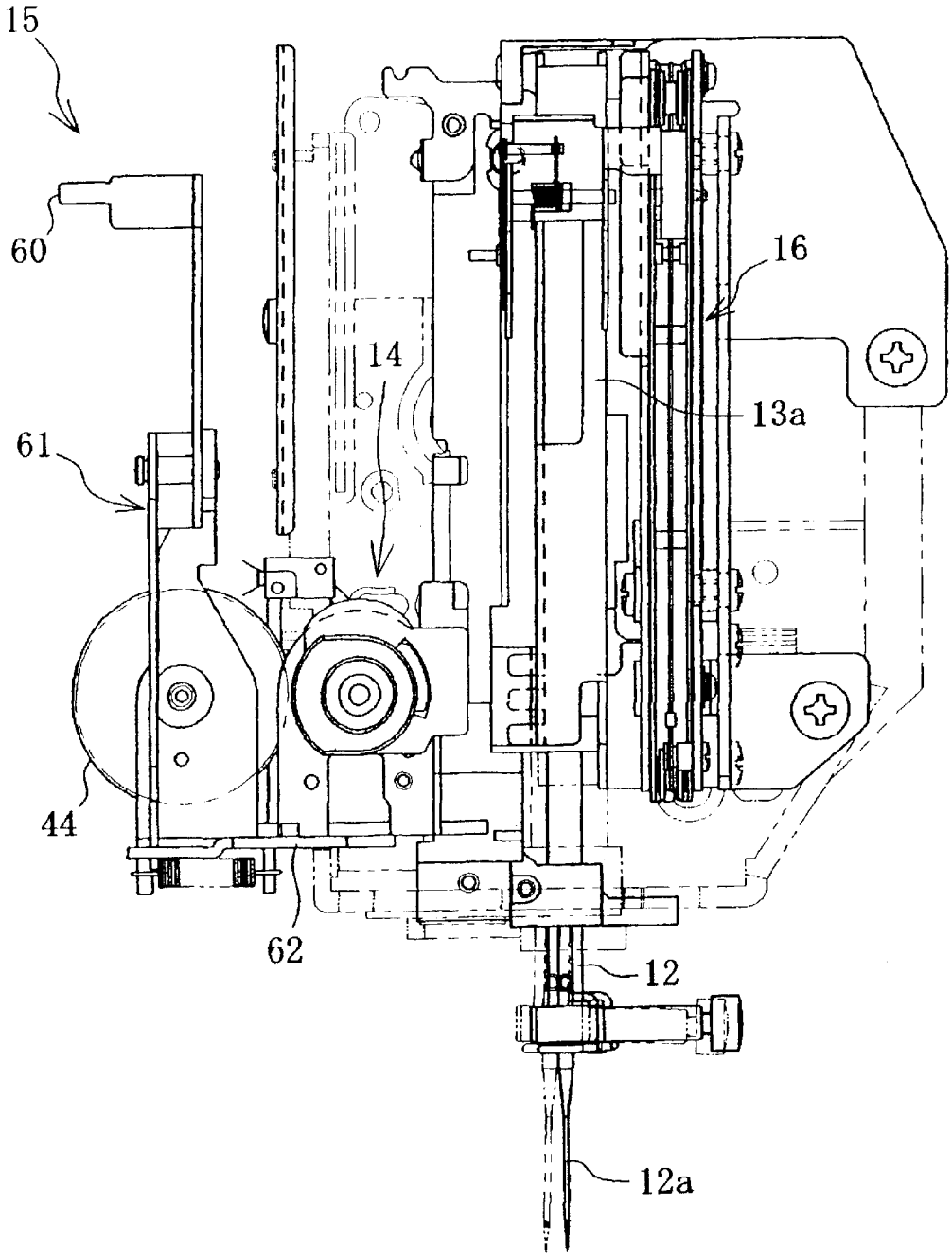
FIG. 9 is a front view of front portions of mechanisms provided in the head of the sewing machine.
Figure 10:
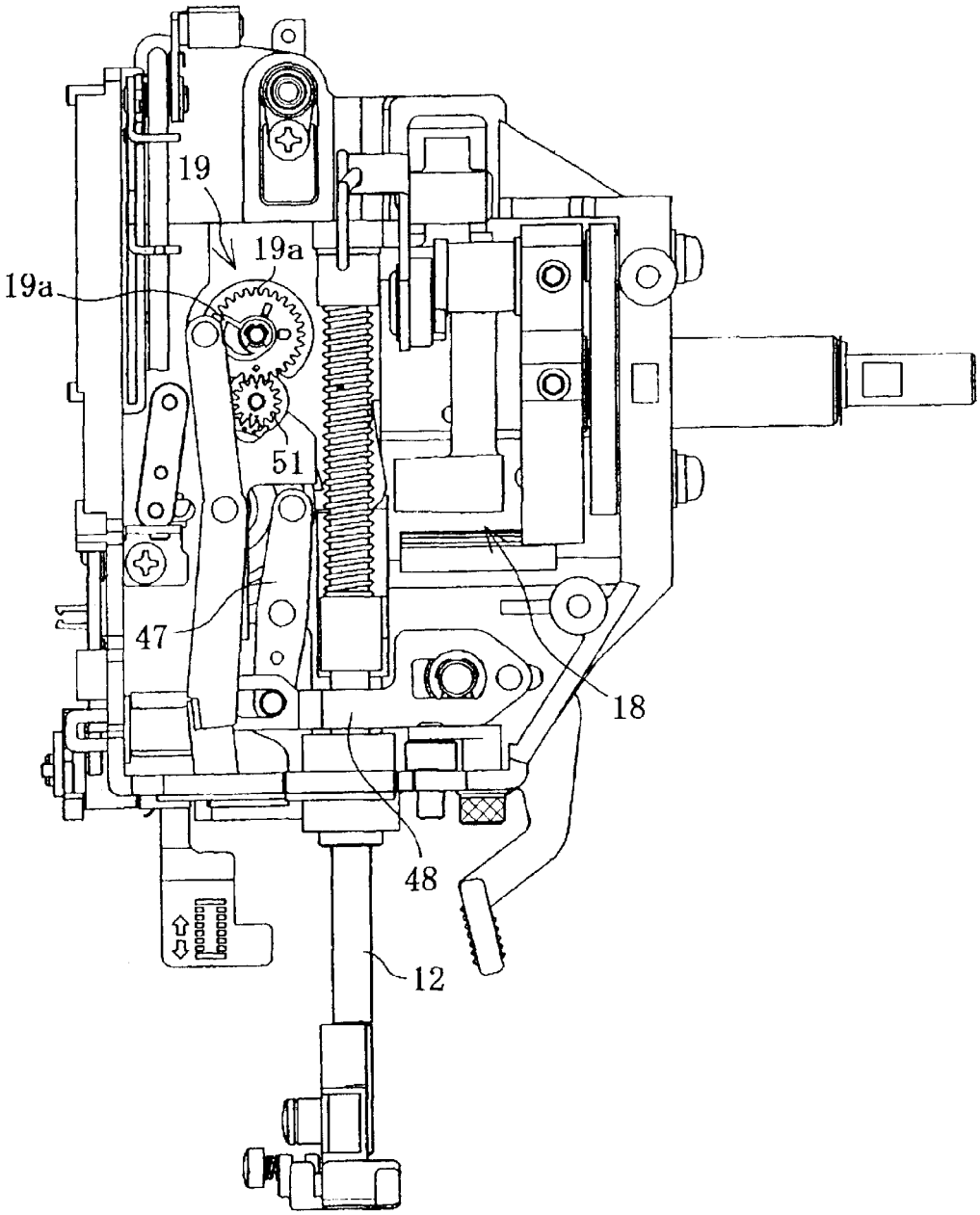
FIG. 10 is also a front view of different front portions of the mechanisms provided in the head.
Figures 12A, 12B:
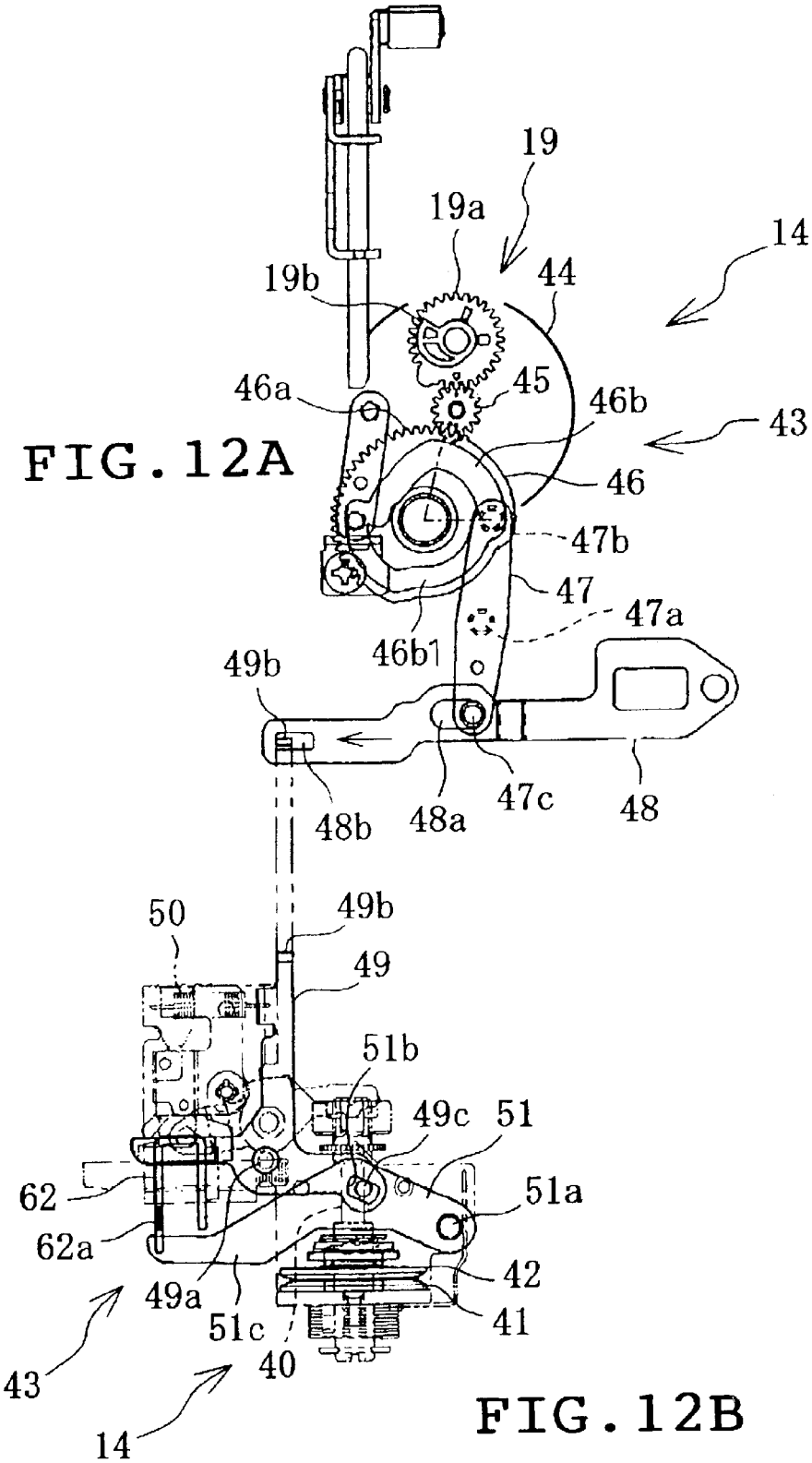
FIGS. 12A and 12B are a plan view and a side view of the thread tensioning mechanism in a closed state respectively.

The thread tension releasing mechanism 15 will be described. The thread tension releasing mechanism 15 comprises a detachment operating member 60 operated so that the thread cassette 10 is detached from the cassette mount 5, an operating force transmitting mechanism 61 including a link mechanism transmitting an operating force of the detachment operating member 60, and a thread releasing member 62 moved forward by the operating force transmitted thereto via the operating force transmitting mechanism 61, as shown in FIGS. 9, 12A and 13A.

When the detachment operating member 60 is operated so that the thread releasing member 62 is moved forward, the lever 51*c* of the pushing member 51 is pushed forward by a pushing portion 62*a* of the thread releasing member 62, whereby the thread tension discs 41 and 42 are opened in the same manner as described above. In this case, the rotating link 49 is rotated clockwise such that the engaging portion 49*b* of the rotating link 49 is moved rightward. However, the link 48 is not moved since the engaging portion 49*b* is engaged with the elongated hole 48*b* of the link 48 so as to be movable rightward.

Figure 14:
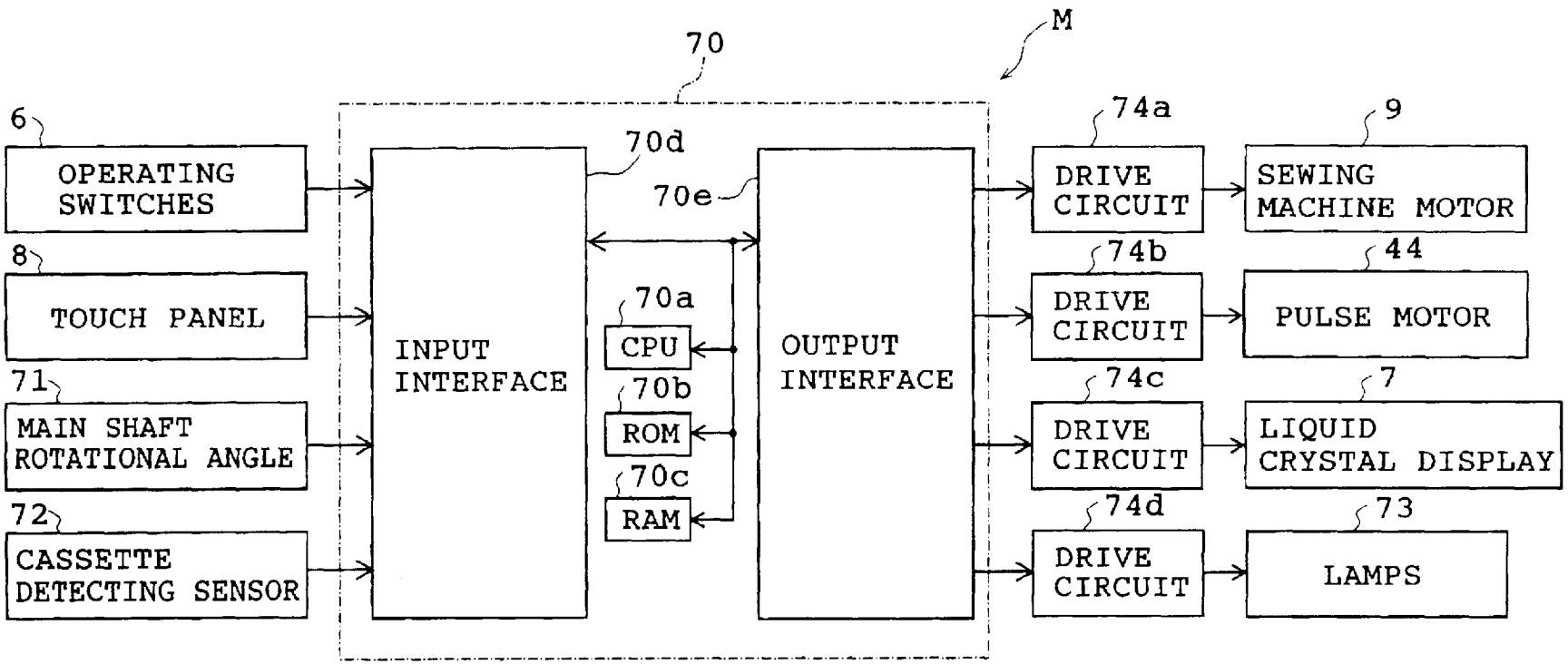
FIG. 14 is a block diagram showing the control system of the sewing machine.

A control system of the sewing machine M will now be described. A control device 70 of the sewing machine M includes a CPU 70*a*, a ROM 70*b*, a RAM 70*c*, an input interface 70*d*, and an output interface 70*e*, as shown in FIG. 14. To the input interface 70*d* are electrically connected the operation switches 6, the touch panel 8, a main shaft rotational angle detecting sensor 71, and a cassette detecting switch 72. To the output interface 70*e* are electrically connected the sewing machine motor 9, the pulse motor 44, the liquid crystal display 17 and drive circuits 74*a* to 74*d* for driving the lamps 73. The control device 70 serves as a thread tension control in the invention.

Figure 15:
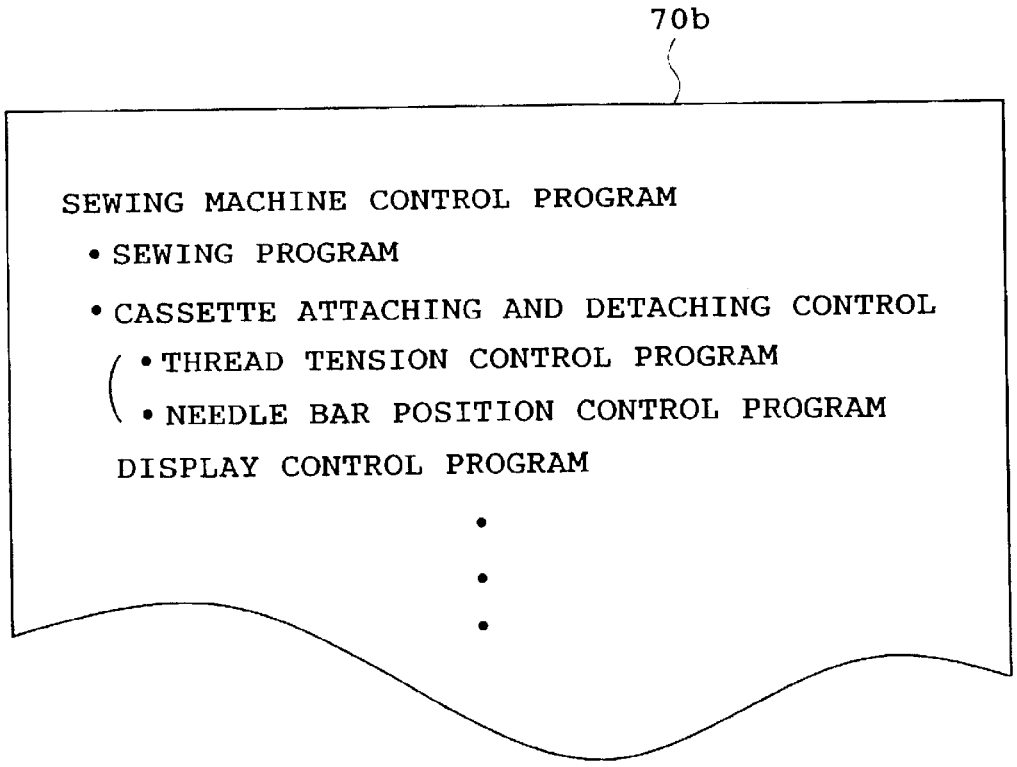
FIG. 15 is a diagram showing a program stored in a ROM provided in the sewing machine.

The ROM 70*b* stores a control program for the sewing machine M as shown in FIG. 15. The control program includes a sewing control program for sewing, a cassette attaching and detaching control program further including a thread tension control program for attaching and detaching the thread cassette 10 to and from the cassette mount 5 and a needle bar position control program, and a display control program for displaying various pieces of information on the liquid crystal display 7.

The cassette attaching and detaching control program includes a first routine in which the thread tensioning mechanism 14 can be controlled so that the thread 11 is tensioned a predetermined period of time (30 msec) after detection of the thread cassette by the cassette detector. The cassette attaching and detaching control program further includes a second routine in which the thread tensioning mechanism 14 can be controlled so that the tension of the thread 11 takes a predetermined value (for example, 0: open state).

Figure 16:
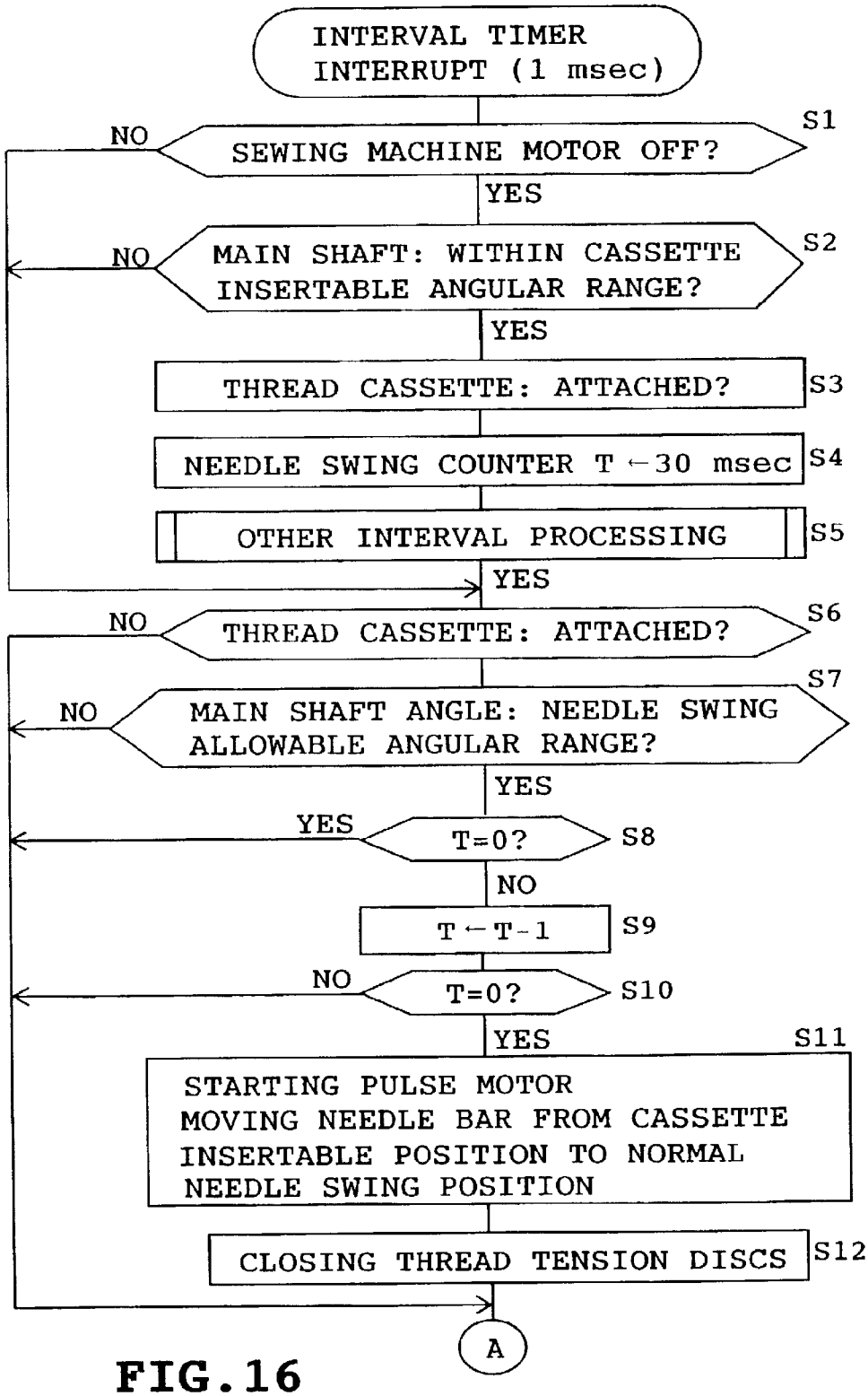
Figure 17:
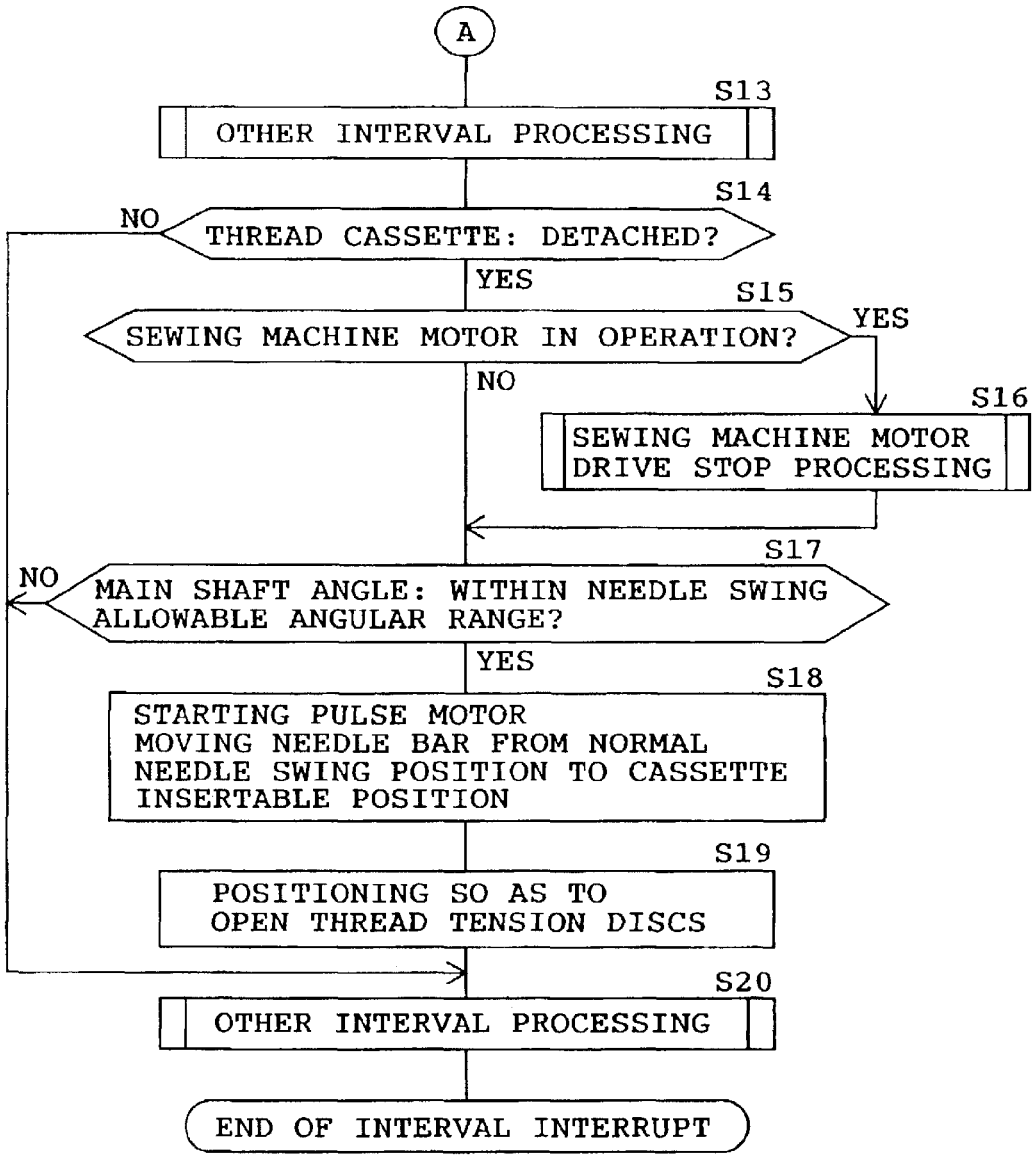

The control including a cassette attaching and detaching control carried out by the control device 70 will now be described with reference to FIGS. 16 and 17. Reference symbol "Si" where i=1, 2, 3 . . . in each flowchart designates an operation step. Steps S1 to S4 and S6 to S12 correspond to the first routine and steps S14 to S19 correspond to the second routine. As shown in FIG. 16, the control begins with an interrupt at intervals of 1 msec. When the sewing machine motor 9 is stopped (S1), the control device 70 advances to step S2. When an angle of the main shaft is within a cassette insertion angular range (S2: YES), the control device 70 advances to step S3. When the cassette detecting switch 72 is turned on and accordingly, the control device 70 determines that the thread cassette 10 has been attached to the cassette mount 5 (S3: YES), the control device advances to step S4 where a needle swing counter T is set at 30 (msec) (S4), advancing to step S5. When determining in the negative at each of steps S1 to S3, the control device 70 thereafter advances to step S5.

A rotational angle of the main shaft is obtained by calculation on the basis of information from a main shaft rotational angle detecting switch 71 comprising an encoder. In this case, a rotational angle of the main shaft is zero (or 360°) when the main shaft is located at a needle upper position which is an upper limit position of the needle bar 12 (needle 12*a*). The cassette insertion angular range at step S2 is previously set at a range from 20° to 50°, for example.

The control device 70 advances to step S7 when a cassette detecting switch 72 is in an ON state after other interval processing or when the thread cassette 10 has been attached to the cassette mount 5 (S6: YES). The control device 70 further advances to step S8 when the main shaft angle is within a needle swing allowable angular range (S7: YES). The needle swing allowable angular range at step S7 is basically determined as a one in the case where the sewing needle 12*a* is located over the needle plate 1*a*, for example, from 280° to 75°.

When the value of the counter T is not zero (S8: NO), the control device 70 advances to step S9 to decrement the counter T to (T−1), thereafter advancing to step S10. When the value of the counter T is zero (S10: YES), the control device 70 advances to step S11. When determining in the negative at each of steps S6 to S8 and S10, the control device 70 thereafter advances to step S13 (see FIG. 17).

When determining in the positive at step S10, the control device 70 advances to step S11 to start the pulse motor 44. The cam 13 is then rotated to a position as shown in FIG. 13A, whereby the needle bar 12 is moved from a cassette insertable position (or left needle position where the threading can desirably be carried out by the threading mechanism 16) to a normal needle swing position (for example, a neutral position where the needle bar is vertical). With this, the control device 70 closes a pair of the thread tensioning discs 41 and 42 at step S12, thereafter advancing to step S13.

The control device 70 carries out the processing for stopping the motor 9 (S16) when determining that the thread cassette 10 has been detached from the cassette mount 5 (S14: YES), as shown in FIG. 17, after other interval processing and further that the sewing machine motor 9 is in operation (S15: YES). Thereafter, when determining that the main shaft angle is within the aforesaid needle swing allowable angular range (S17: YES), the control device 70 advances to step S18. The pulse motor 44 is driven to rotate the cam 13 to the position as shown in FIG. 12A, at step S18. As a result, the needle bar 12 is moved from the aforesaid normal needle swing position to the aforesaid cassette insertable position. With this, the control device 70 opens the thread tensioning discs 41 and 42 and thereafter carrying out other interval processing (step S20), finishing the control. When determining in the negative at each of steps S14 and S17, the control device 70 thereafter advances to step S20.

As described above, the sewing machine M is provided with the cassette mount 5 to which the thread cassette 10 having the thread accommodating cavity 23 for accommodating the thread spool 22 therein is detachably attached. The sewing machine M comprises the thread tensioning mechanism 14 for adjusting the tension of the thread drawn from the thread cassette 10, the cassette detecting switch 72 detecting the thread cassette 10 having been attached to the cassette mount 5, and the control device 70 controlling the thread tensioning mechanism 14 so that the thread 11 is tensioned a predetermined period of time (30 msec) after detection of the thread cassette 10 by the cassette detecting switch 72.

Since the thread 11 drawn from the thread cassette 10 is tensioned by the thread tensioning mechanism 14 upon lapse of the predetermined period of time (30 msec) after detection of the thread cassette 10, the thread 11 can reliably be placed on the thread tension shaft 40 and held by the thread tensioning discs 41 and 42 of the thread tensioning mechanism 14. Thus, the tension of the thread 11 drawn from the thread cassette 10 can be adjusted reliably and desirably.

When the aforesaid predetermined period of time set is above 30 msec, the needle bar 12 displaced relative to attachment of the thread cassette 10 would sometimes be moved from the cassette insertable position to a needle swing position. This movement may frighten the user. In the foregoing sewing machine, however, the predetermined period of time is set at 30 msec, the needle bar 12 is operated substantially simultaneously with attachment of the thread cassette 10. Consequently, the problem that a sudden operation of the needle bar 12 frightens the user can be overcome.

Furthermore, the sewing machine M is provided with the detachment operating member 60 operated so that the thread cassette 10 is detached from the cassette mount 5. The control device 70 controls the thread tensioning mechanism 14 so that the thread 11 is set at a predetermined tension or more specifically, the thread tension discs 41 and 42 are opened when the detachment operating member 60 has been operated.

According to the above-described arrangement, the thread tension discs 41 and 42 are opened by the thread tensioning mechanism 14 under control of the control device 70. Accordingly, since the thread 11 drawn from the thread cassette 10 is reliably be released from the thread tensioning mechanism 14, the thread can be prevented from being caught by the thread tensioning mechanism. Since the thread cassette 10 is smoothly detached from the cassette mount 5, the load imposed on the operator can be reduced. Consequently, the tension of the thread drawn from the thread cassette can be adjusted reliably and desirably.

Furthermore, the sewing machine M is further provided with the thread tension releasing mechanism 15 operated in synchronization with the detachment operating member 60 and opening the thread tension discs 41 and 42 when the detachment operating member has been operated. The timing of thread tension release by the thread tension releasing mechanism 15 is set to occur earlier than the timing of opening the thread tension discs by the control device 70, whereupon when the detachment operating member 60 is operated, the thread tension discs 41 and 42 are rapidly opened by the thread tensioning mechanism 14, whereupon the detachment of the thread cassette 10 can desirably be coped with.

When power is disconnected from the sewing machine M and accordingly, even when the control of the control device 70 for the thread tensioning mechanism 14 is ineffective, the thread tension discs 41 and 42 can be opened when the detachment operating member 60 is operated. Consequently, the thread cassette 10 can smoothly be detached from the cassette mount 5 without the thread 11 being caught by the thread tensioning mechanism 14.

Several modifications will be described. The thread cassette in the foregoing embodiment is merely an example and accordingly, the thread cassette should not be limited to the one including the thread source comprising a thread spool or the like on which a thread is wound up. The thread cassette may comprise a storing section in which a lump of thread serving as a thread source is stored. Furthermore, at least one of walls covering the thread storing section may be eliminated and a thread spool may be held on a holding section such as a spool pin.

The thread releasing mechanism 15 may be eliminated and the thread tensioning mechanism 14 may be constructed so as not to be opened by an operating force applied to the detachment operating member 60 when the member 60 is operated. Furthermore, a detecting switch may be provided for directly detecting the detachment operating member 60 or indirectly detecting detachment of the thread cassette 10 from the cassette mount 5, and thread tensioning mechanism 14 may be controlled so that the thread tension discs 41 and 42 are opened. Additionally, the foregoing predetermined period of time may be set at various times (for example, 20 msec or 40 msec) other than 30 msec.

The thread tensioning mechanism 14 and the needle bar swinging mechanism 19 need not be driven by a single pulse motor 44. These mechanisms 14 and 19 may be provided with individual actuators such as electric motors respectively. In this construction, when the user has operated the sewing machine M to change the set thread tension, the individual actuator for the thread tensioning mechanism 14 is operated so that the changed thread tension is set. More specifically, the thread tensioning mechanism 14 may be opened by an actuator automatically changing the thread tension for the sewing at the time of detachment of the thread cassette.

In the foregoing embodiment, the thread tensioning mechanism 14 is opened so that the thread is not tensioned. However, the tension the thread tensioning mechanism 14 applies to the thread may be rendered weaker (for example, approximately zero), instead. In this case, too, substantially the same effect can be achieved. The predetermined thread tension may refer to the state where tension applied to the thread is weak or where no tension is applied to the thread.

The control device 70 includes a ROM 70*b* storing a cassette attachment and detachment control program including a thread tension control program. The program may be applied to sewing machines similar to the foregoing sewing machine M. More specifically, the cassette attachment and detachment control program or the thread tension control program may be supplied to users via an Internet or by means of a recording medium, such as CD, MD and FD, on which the program is recorded.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing machine comprising:

a thread cassette having a thread accommodating cavity in which a supply of thread is stored;

a cassette mount to which the thread cassette is detachably attached;

a thread tensioner adjusting a tension of the thread drawn from the thread cassette;

a detachment operating member operated so that the thread cassette is detached from the cassette mount; and a thread tension control controlling the thread tensioner so that the thread is set at a predetermined tension when the detachment operating member has been operated.

2. A sewing machine according to claim 1, wherein the thread tension control opens the thread tensioner when the detachment operating member has been operated.

3. A sewing machine according to claim 2, wherein the thread tensioner applies no tension to the thread when the thread tensioner is opened.

4. A sewing machine according to claim 1, further comprising a thread tensioner opening mechanism operated in synchronization with the detachment operating member and opening the thread tensioner when the detachment operating member is operated.

5. A sewing machine according to claim 2, further comprising a thread tensioner opening mechanism operated in synchronization with the detachment operating member and opening the thread tensioner when the detachment operator is operated.

6. A sewing machine according to claim 3, further comprising a thread tensioner opening mechanism operated in synchronization with the detachment operating member and opening the thread tensioner when the detachment operating member is operated.

7. A sewing machine comprising:

a thread cassette having a thread accommodating cavity in which a supply of thread is stored;

a cassette mount to which the thread cassette is detachably attached;

a thread tensioner adjusting a tension of the thread drawn from the thread cassette;

a cassette detector detecting the thread cassette having been attached to the cassette mount; and a thread tension control controlling the thread tensioner so that the thread is tensioned a predetermined period of time after detection of the thread cassette by the cassette detector.

8. A sewing machine according to claim 7, wherein the predetermined period of time is set at a value not more than 30 msec.

9. A thread tension control program executed by a computer provided for a sewing machine, accomplishing the functions of:

controlling a thread tensioner adjusting a tension of the thread drawn from a thread cassette having a thread accommodating cavity in which a supply of thread is accommodated when the thread cassette is attached to or detached from a cassette mount of the sewing machine; and controlling the thread tensioner so that the thread is set at a predetermined tension when a detachment operator has been operated, the detachment operator being operated so that the thread cassette is detached from the cassette mount.

10. A thread tension control program executed by a computer provided for a sewing machine, accomplishing the functions of:

controlling a thread tensioner adjusting a tension of the thread drawn from a thread cassette having a thread accommodating cavity in which a supply of thread is accommodated when the thread cassette is attached to or detached from a cassette mount of the sewing machine; and controlling the thread tensioner so that the thread is tensioned a predetermined period of time after detection of the thread cassette having been attached to the cassette mount by a cassette detector.

* * * * *